US007153777B2

(12) United States Patent
Lee

(10) Patent No.: US 7,153,777 B2
(45) Date of Patent: Dec. 26, 2006

(54) METHODS AND APPARATUSES FOR ELECTROCHEMICAL-MECHANICAL POLISHING

(75) Inventor: Whonchee Lee, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 223 days.

(21) Appl. No.: 10/783,763

(22) Filed: Feb. 20, 2004

(65) Prior Publication Data

US 2005/0196963 A1 Sep. 8, 2005

(51) Int. Cl.
*H01L 21/302* (2006.01)

(52) U.S. Cl. ..... 438/692; 451/287; 205/662

(58) Field of Classification Search ..... 438/689–693; 451/287, 288, 443, 444; 205/662, 670, 671, 205/672

See application file for complete search history.

(56) References Cited

U.S. PATENT DOCUMENTS

| | | | |
|---|---|---|---|
| 2,315,695 | A | 4/1943 | Faust |
| 2,516,105 | A | 7/1950 | der Mateosian |
| 3,239,439 | A | 3/1966 | Helmke |
| 3,334,210 | A | 8/1967 | Williams et al. |
| 4,839,005 | A | 6/1989 | Katsumoto et al. |
| 5,098,533 | A | 3/1992 | Duke et al. |
| 5,162,248 | A | 11/1992 | Dennison et al. |
| 5,244,534 | A | 9/1993 | Yu et al. |
| 5,300,155 | A | 4/1994 | Sandhu et al. |
| 5,344,539 | A | 9/1994 | Shinogi et al. |
| 5,562,529 | A | 10/1996 | Kishii et al. |
| 5,567,300 | A | 10/1996 | Datta et al. |
| 5,575,885 | A | 11/1996 | Hirabayashi et al. |
| 5,618,381 | A | 4/1997 | Doan et al. |
| 5,624,300 | A | 4/1997 | Kishii et al. |
| 5,676,587 | A | 10/1997 | Landers et al. |
| 5,681,423 | A | 10/1997 | Sandhu et al. |
| 5,780,358 | A | 7/1998 | Zhou et al. |
| 5,807,165 | A | 9/1998 | Uzoh et al. |
| 5,840,629 | A | 11/1998 | Carpio |
| 5,843,818 | A | 12/1998 | Joo et al. |
| 5,846,398 | A | 12/1998 | Carpio |
| 5,863,307 | A | 1/1999 | Zhou et al. |
| 5,888,866 | A | 3/1999 | Chien |
| 5,897,375 | A | 4/1999 | Watts et al. |
| 5,911,619 | A | 6/1999 | Uzoh et al. |

(Continued)

FOREIGN PATENT DOCUMENTS

EP 0459397 A2 12/1991

(Continued)

OTHER PUBLICATIONS

U.S. Appl. No. 09/651,779, filed Aug. 30, 2000, Moore.

(Continued)

*Primary Examiner*—Kin-Chan Chen
(74) *Attorney, Agent, or Firm*—Perkins Coie LLP

(57) ABSTRACT

Methods and apparatuses for removing material from a microfeature workpiece are disclosed. In one embodiment, the microfeature workpiece is contacted with a polishing surface of a polishing medium, and is placed in electrical communication with first and second electrodes, at least one of which is spaced apart from the workpiece. A polishing liquid is disposed between the polishing surface and the workpiece and at least one of the workpiece and the polishing surface is moved relative to the other. Material is removed from the microfeature workpiece and at least a portion of the polishing liquid is passed through at least one recess in the polishing surface so that a gap in the polishing liquid is located between the microfeature workpiece and the surface of the recess facing toward the microfeature workpiece.

24 Claims, 4 Drawing Sheets

U.S. PATENT DOCUMENTS 5,930,699 A 7/1999 Bhatia
5,934,980 A 8/1999 Koos et al.
5,952,687 A 9/1999 Kawakubo et al.
5,954,975 A 9/1999 Cadien et al.
5,954,997 A 9/1999 Kaufman et al.
5,972,792 A 10/1999 Hudson
5,993,637 A 11/1999 Hisamatsu et al.
6,001,730 A 12/1999 Farkas et al.
6,007,695 A 12/1999 Knall et al.
6,010,964 A 1/2000 Glass
6,024,856 A 2/2000 Haydu et al.
6,033,953 A 3/2000 Aoki et al.
6,039,633 A 3/2000 Chopra
6,046,099 A 4/2000 Cadien et al.
6,051,496 A 4/2000 Jang
6,060,386 A 5/2000 Givens
6,060,395 A 5/2000 Skrovan et al.
6,063,306 A 5/2000 Kaufman et al.
6,066,030 A 5/2000 Uzoh
6,066,559 A 5/2000 Gonzalez et al.
6,068,787 A 5/2000 Grumbine et al.
6,083,840 A 7/2000 Mravic et al.
6,100,197 A 8/2000 Hasegawa
6,103,096 A 8/2000 Datta et al.
6,103,628 A 8/2000 Talieh
6,103,636 A 8/2000 Zahorik et al.
6,115,233 A 9/2000 Seliskar et al.
6,117,781 A 9/2000 Lukanc et al.
6,121,152 A 9/2000 Adams et al.
6,132,586 A 10/2000 Adams et al.
6,143,155 A 11/2000 Adams et al.
6,162,681 A 12/2000 Wu
6,171,467 B1 1/2001 Weihs et al.
6,174,425 B1 1/2001 Simpson et al.
6,176,992 B1 1/2001 Talieh
6,180,947 B1 1/2001 Stickel et al.
6,187,651 B1 2/2001 Oh
6,190,494 B1 2/2001 Dow
6,196,899 B1 3/2001 Chopra et al.
6,197,182 B1 3/2001 Kaufman et al.
6,206,756 B1 3/2001 Chopra et al.
6,218,309 B1 4/2001 Miller et al.
6,250,994 B1 6/2001 Chopra et al.
6,259,128 B1 7/2001 Adler et al.
6,273,786 B1 8/2001 Chopra et al.
6,276,996 B1 8/2001 Chopra
6,280,581 B1 8/2001 Cheng
6,287,974 B1 9/2001 Miller
6,299,741 B1 10/2001 Sun et al.
6,303,956 B1 10/2001 Sandhu et al.
6,313,038 B1 11/2001 Chopra et al.
6,322,422 B1 11/2001 Satou
6,328,632 B1 12/2001 Chopra
6,368,184 B1 4/2002 Beckage
6,368,190 B1 4/2002 Easter et al.
6,379,223 B1 4/2002 Sun et al.
6,395,607 B1 5/2002 Chung
6,416,647 B1 7/2002 Dordi et al.
6,455,370 B1 9/2002 Lane
6,461,911 B1 10/2002 Ahn et al.
6,464,855 B1 10/2002 Chadda et al.
6,504,247 B1 1/2003 Chung
6,620,037 B1 9/2003 Kaufman et al.
6,689,258 B1 2/2004 Lansford et al.
6,693,036 B1 2/2004 Nogami et al.
6,722,942 B1 4/2004 Lansford et al.
6,722,950 B1 4/2004 Dabral et al.
6,736,952 B1 5/2004 Emesh et al.
6,753,250 B1 6/2004 Hill et al.
6,776,693 B1 8/2004 Duboust et al.
6,780,772 B1 8/2004 Uzoh et al.
6,846,227 B1 1/2005 Sato et al.
6,848,970 B1 * 2/2005 Manens et al. ..... 451/5
6,852,630 B1 * 2/2005 Basol et al. ..... 438/691
6,867,136 B1 * 3/2005 Basol et al. ..... 438/687
6,881,664 B1 4/2005 Catabay et al.
6,893,328 B1 * 5/2005 So ..... 451/41
2001/0025976 A1 10/2001 Lee
2001/0036746 A1 11/2001 Sato et al.
2002/0025759 A1 2/2002 Lee et al.
2002/0025760 A1 2/2002 Lee et al.
2002/0025763 A1 2/2002 Lee et al.
2002/0052126 A1 5/2002 Lee et al.
2002/0070126 A1 6/2002 Sato et al.
2002/0104764 A1 8/2002 Banerjee et al.
2002/0115283 A1 8/2002 Ho et al.
2003/0054729 A1 * 3/2003 Lee et al. ..... 451/5
2003/0064669 A1 4/2003 Basol et al.
2003/0109198 A1 6/2003 Lee et al.
2003/0129927 A1 7/2003 Lee et al.
2003/0178320 A1 9/2003 Liu et al.
2003/0226764 A1 12/2003 Moore et al.
2004/0192052 A1 9/2004 Mukherjee et al.
2004/0214510 A1 * 10/2004 So ..... 451/41
2004/0259479 A1 * 12/2004 Sevilla ..... 451/41
2005/0133379 A1 * 6/2005 Basol et al. ..... 205/652
2005/0173260 A1 * 8/2005 Basol et al. ..... 205/662
2005/0178743 A1 * 8/2005 Manens et al. ..... 216/88

FOREIGN PATENT DOCUMENTS

EP 0459397 A3 12/1991
EP 1 123 956 A1 8/2001
JP 1241129 A 9/1989
JP 2001077117 A1 3/2001
WO WO 00/26443 A2 5/2000
WO WO 00/26443 A3 5/2000
WO WO 00/28586 A2 5/2000
WO WO 00/28586 A3 5/2000
WO WO 00/32356 A1 6/2000
WO WO 00/59008 A2 10/2000
WO WO 00/59008 A3 10/2000
WO WO 00/59682 A1 10/2000
WO WO 02/064314 A1 8/2002

OTHER PUBLICATIONS

U.S. Appl. No. 09/651,808, filed Aug. 30, 2000, Chopra et al.
U.S. Appl. No. 09/653,392, filed Aug. 31, 2000, Chopra et al.
U.S. Appl. No. 09/653,411, filed Aug. 31, 2000, Lee et al.
U.S. Appl. No. 10/230,463, filed Aug. 29, 2002, Lee et al.
U.S. Appl. No. 10/230,602, filed Aug. 29, 2002, Chopra.
U.S. Appl. No. 10/230,628, filed Aug. 29, 2002, Lee et al.
U.S. Appl. No. 10/665,219, filed Sep. 17, 2003, Lee.
Aboaf, J.A. and R.W. Broadie, IBM Technical Disclosure Bulletin, Rounding of Square-Shape Holes in Silicon Wafers, vol. 19, No. 8, p. 3042, Jan. 1977, XP-002235690, NN 77013042.
ATMI, Inc., adapted from a presentation at the Semicon West '99 Low Dielectric Materials Technology Conference, San Francisco, California, Jul. 12, 1999, pp. 13-25.
Bassous; E., IBM Technical Disclosure Bulletin, Low Temperature Methods for Rounding Silicon Nozzles, vol. 20, No. 2, Jul. 1977, pp. 810-811, XP-002235692, NN 7707810.
Bernhardt, A.F., Contolini, R.J., Mayer, S.T, "Electrochemical Planarization for Multi-Level Metallization of Microcircuitry," *CircuiTree Journal*, vol. 8, No. 10, pp. 38, 40, 42, 44, 46, and 48, Oct. 1995.
D'Heurle, F.M. and K.C. Park, IBM Technical Disclosure Bulletin, Electrolytic Process for Metal Pattern Generation, vol. 17, No. 1, pp. 271-272, Jun. 1974, XP-002235691, NN 7406271.
Frankenthal, R.P. and Eaton, D.H., "Electroetching of Platinum in the Titanium-Platinum-Gold Metallization on Silicon Integrated Circuits", *Journal of The Electrochemical Society*, vol. 123, No. 5, pp. 703-706, May 1976.

Huang, C.S. et al., "A Novel UV Baking Process to Improve DUV Photoresist Hardness," pp. 135-138, Proceedings of the 1999 International Symposium on VLSI Technology, Systems, and Applications: Proceedings of Technical Papers: Jun. 8-10, 1999, Taipei, Taiwan, Institute of Electrical and Electronics Engineers, Inc., Sep. 1999.

Juchniewicz, R. et al. "Influence of Pulsed Current of Platinised Titanium and Tantalum Anode Durability," International Congress on Metallic Corrosion, Proceedings—vol. 3, pp. 449-453, Toronto, Jun. 3-7, 1984.

Kondo, S. et al., "Abrasive-Free Polishing for Copper Damascence Interconnection," *Journal of the Electrochemical Society*, vol. 147, No. 10, pp. 3907-3913, The Electrochemical Society, Inc., Pennington, New Jersey, 2000.

McGraw-Hill, *Concise Encyclopedia of Science & Technology*, Sybil P. Parker, Editor in Chief, Fourth Edition, p. 367, McGraw-Hill, New York, 1998.

Micro Photonics, Inc., "CSM Nano Hardness Tester," 6 pages, retrieved from the Internet on Jul. 29, 2002, <http://www.microphotonics.com/nht.html>.

Micro Photonics, Inc., CSM Application Bulletin, "Low-load Micro Scratch Tester (MST) for characterisation of thin polymer films," 3 pages, retrived from the Internet on Jul. 25, 2002, <http://www.microphotonics.com/mstABpoly.html>.

PhysicsWorld, "Hard Materials", excerpt of "Superhard Superlattices," 1 page, Jan. 1998, S. Barnett and A. Madan, retrieved from the Internet on Jul. 29, 2002, <http://physicsweb.org/box/world/11/1/11/world-11-1-11-1>.

* cited by examiner

METHODS AND APPARATUSES FOR ELECTROCHEMICAL-MECHANICAL POLISHING

TECHNICAL FIELD

The present invention relates generally to microfeature workpiece processing, and more particularly relates to methods and apparatuses for electrochemical-mechanical polishing and/or planarization (ECMP) of microfeature workpieces.

BACKGROUND

Integrated circuits typically originate from semiconductor wafers. The production of semiconductor wafers is based on a number of different operations, including masking, etching, deposition, planarization, etc. Typically, planarization operations are based on a chemical mechanical planarization (CMP) process. During CMP processes, a wafer carrier holds and rotates the semiconductor wafer while the wafer contacts a CMP pad. In particular, during the planarization process, the CMP system applies pressure to the wafer carrier causing the wafer to press against a polishing surface of the CMP pad. The wafer carrier and/or the polishing surface of the CMP pad are rotated relative to each other to planarize the surface of the wafer.

Another method for planarizing wafers includes electrochemical-mechanical planarization (ECMP), in which electric potentials are applied to the wafer while it undergoes a CMP process. In a conventional ECMP system an electric potential is applied to the wafer with an electrolytic planarizing liquid. The electric potential applied to the wafer causes metal ions to be driven from the metal layer of the wafer via electropolishing, while additional material is removed via electrochemical-mechanical polishing. Accordingly, the over removal rate is characterized by the following equation:

$$\text{Removal rate} = \text{electropolishing (EP) rate} + \text{electrochemical-mechanical polishing (ECMP) rate}, \quad (1)$$

where the EP rate is the rate at which material is removed solely by electrical polishing, and the ECMP rate is the rate at which material is removed by the chemical solution in combination with both the physical application of the pad to the surface of the wafer and additional electrical interactions. However, the uncontrolled application of both electropolishing and ECMP to the wafer may not produce an overall material removal rate that is acceptably uniform.

DETAILED DESCRIPTION

Figure 1:
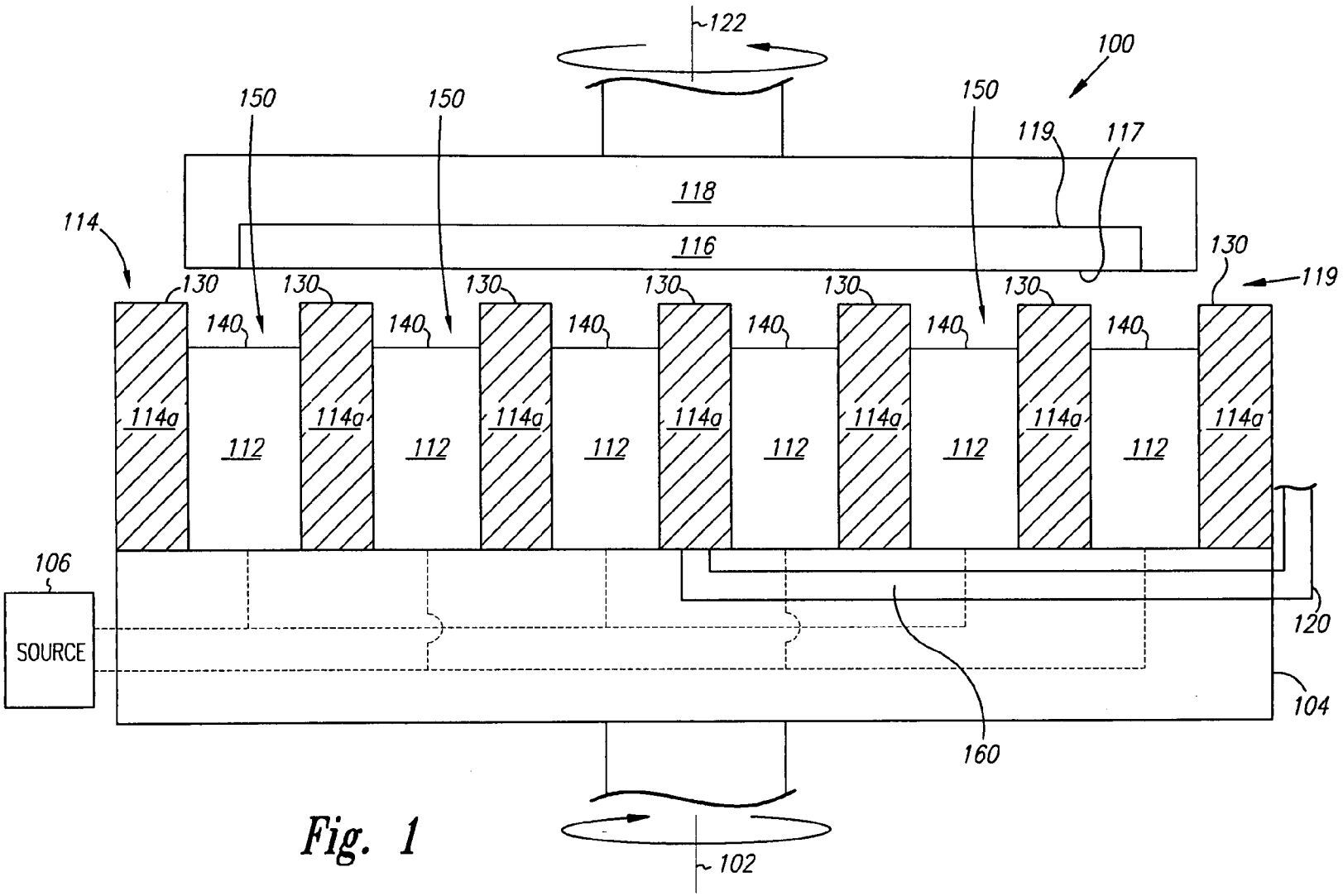
FIG. 1 is a schematic side view of a system for removing material from a microfeature workpiece using electrochemical-mechanical polishing techniques in accordance with an embodiment of the invention.

The present invention is directed toward methods and apparatuses for removing material from microfeature workpieces by electrochemical-mechanical polishing. A method in accordance with one aspect of the invention includes contacting a microfeature workpiece with a polishing surface of polishing medium, placing the microfeature workpiece in electrical communication with a first electrode and a second electrode, with at least one of the electrodes being spaced apart from the microfeature workpiece, and disposing a polishing liquid between the polishing surface and the microfeature workpiece. At least one of the microfeature workpiece and the polishing surface is moved relative to the other. Electrical current is passed through the electrodes and the microfeature workpiece to remove material from the microfeature workpiece while the microfeature workpiece contacts the polishing surface. At least a portion of the polishing liquid is passed through at least one recess in the polishing surface so that a gap in the polishing liquid is located between the microfeature workpiece and a surface of the recess facing toward the microfeature workpiece.

In further particular aspects of the invention, the microfeature workpiece can be rotated relative to the polishing pad. Removing material from the microfeature workpiece can include removing at least a first portion of the material by electrochemical-mechanical polishing and removing no material by electropolishing, or removing a second portion less than the first portion by electropolishing. The microfeature workpiece can be rotated at a rate of from about 50 rpm to about 500 rpm, and the polishing liquid can be disposed at the rate of less than one liter per minute.

An apparatus in accordance with another aspect of the invention includes a support member configured to releasably carry a microfeature workpiece at a polishing position. First and second electrodes are positioned to conduct electrical current to a microfeature workpiece when the workpiece is carried by the support member, with at least one of the electrodes being spaced apart from the workpiece when the workpiece is carried by the support member. A polishing medium is disposed between at least one electrode and the support member with at least one of the polishing medium and the support member being movable relative to the other. The polishing medium has a polishing surface with at least one recess positioned to receive a polishing liquid. The least one recess has a recess surface facing toward the support member and spaced apart from the polishing surface to allow polishing liquid in the recess to form a gap between the polishing position and the recess surface.

In further particular aspects of the invention, the recess can have a dimension generally normal to the polishing surface of from about 0.5 mm to about 10 mm, and in still a further particular embodiment, from about 2 mm to about 4 mm. In yet another particular embodiment, the recess surface includes a surface of the at least one electrode, and the polishing surface faces upwardly toward the support member.

As used herein, the terms "microfeature workpiece" or "workpiece" refer to substrates on and/or in which microelectronic devices are integrally formed. Typical microdevices include microelectronic circuits or components, thin-film recording heads, data storage elements, microfluidic devices, and other products. Micromachines and micromechanical devices are included within this definition because they are manufactured using much of the same technology that is used in the fabrication of integrated circuits. The substrates can be semiconductive pieces (e.g., doped silicon wafers or gallium arsenide wafers), nonconductive pieces (e.g., various ceramic substrates) or conductive pieces. In some cases, the workpieces are generally round, and in other cases the workpieces have other shapes, including rectilinear shapes. Several embodiments of systems and methods for removing material from microfeature workpieces via electrochemical-mechanical polishing (ECMP) are described below. A person skilled in the relevant art will understand, however, that the invention may have additional embodiments, and that the invention may be practiced without several of the details of the embodiments described below with reference to FIGS. 1–4.

References in the specification to "one embodiment" or "an embodiment" indicate that the embodiment described may include a particular feature, structure, or characteristic, but every embodiment may not necessarily include the particular feature, structure, or characteristic. Moreover, such phrases do not necessarily refer to the same embodiment. Further, while a particular feature, structure, or characteristic may be described in connection with a particular embodiment, such a feature, structure, or characteristic can also be included in other embodiments, whether or not explicitly described.

Embodiments of the invention can include features, methods or processes embodied within machine-executable instructions provided by a machine-readable medium. A machine-readable medium includes any mechanism that provides (i.e., stores and/or transmits) information in a form accessible by a machine (e.g., a computer, a network device, a personal digital assistant, manufacturing tool, or any device with a set of one or more processors). In an exemplary embodiment, a machine-readable medium includes volatile and/or non-volatile media (e.g., read only memory (ROM); random access memory (RAM); magnetic disk storage media; optical storage media; flash memory devices; etc.), as well as electrical, optical, acoustical or other form of propagated signals (e.g., carrier waves, infrared signals, digital signals, etc.).

Machine-executable instructions are used to cause a general or special purpose processor, programmed with the instructions, to perform methods or processes in accordance with embodiments of the invention. Alternatively, the methods can be performed by specific hardware components which contain hard-wired logic for performing the operations, or by any combination of programmed data processing components and specific hardware components. Embodiments of the invention include software, data processing hardware, data processing system-implemented methods, and various processing operations, further described herein.

A number of figures show block diagrams of systems and apparatuses for electrochemical-mechanical polishing, in accordance with embodiments of the invention. A number of figures show flow diagrams illustrating operations for electrochemical-mechanical planarization. The operations of the flow diagrams will be described with references to the systems shown in the block diagrams. However, it should be understood that the operations identified in the flow diagrams can be performed by systems and apparatuses other than those discussed with reference to the block diagrams, and the systems and apparatuses can perform operations different than those described with reference to the flow diagrams.

FIG. 1 is a schematic illustration of a system 100 for removing material by ECMP in accordance with an embodiment of the invention. The system 100 can include a carrier or other support member 118 configured to hold a microfeature workpiece 116 having a surface 117 that is to be polished or planarized at a polishing plane 119. The support member 118 can rotate about an axis 122. In one embodiment, a rotation speed of the support member 118 holding the microfeature workpiece 116 during polishing ranges from approximately 10 rotations per minute (rpm) to about 500 rpm. In further particular embodiments, the support member 118 rotates at from about 50 rpm to about 200 rpm, or at about 100 rpm.

A platen 104 can be positioned proximate to the support member 118. The platen 104 can support a plurality of electrodes 112, each having an electrode surface 140 facing toward the workpiece 116. The electrodes 112 can be coupled to an electrical potential source 106. In one aspect of this embodiment, the source 106 includes an alternating current source configured to deliver a varying current to the electrodes 112. The current can have a sinusoidal variation, a sawtooth variation, superimposed frequencies, or other repeating or non-repeating patterns. Further embodiments for providing the electrical current are disclosed in pending U.S. application Ser. No. 09/651,779 filed Aug. 30, 2000 and incorporated herein in its entirety by reference. In any of these embodiments, some of the electrodes 112 can be coupled to one pole of the source 106 (at a first potential) and other electrodes 112 can be coupled to another pole of the source 106 (at another potential) to provide a current path that passes from one electrode 112 through the workpiece 116 to another electrode 112, in a manner described in greater detail below.

In a particular embodiment shown in FIG. 1, electrodes 112 coupled to both poles of the source 106 are spaced apart from the microfeature workpiece 116. In another embodiment, one or more electrodes 112 coupled to one of the poles can be in direct contact with the microfeature workpiece 116. For example, one or more of the electrodes 112 can be placed in direct contact with conductive material at the surface 117 of the workpiece 116. In another arrangement, one or more of the electrodes 112 can contact a back surface 119 of the workpiece 116, with internal circuitry of the workpiece 116 providing a conductive link to the opposite surface 117.

The platen 104 can also support a polishing medium that includes a polishing pad 114. The polishing pad 114 can include a plurality of polishing pad portions 114*a*, each of which is formed from a polishing pad material. Suitable polishing pad materials are available from Rodel, Inc. of Phoenix, Ariz. In an embodiment shown in FIG. 1, the polishing pad portions 114*a* are positioned between neighboring electrodes 112 and are spaced apart from each other. In another embodiment, the polishing pad portions 114*a* are connected to each other. In any of these embodiments, each polishing pad portion 114*a* can include a polishing surface 130 positioned to contact the workpiece 116. In a further aspect of these embodiments, the polishing surfaces 130 are positioned in a different plane than the electrode surfaces 140. For example, when the platen 104 is positioned beneath the support member 118, the polishing surfaces 130 are above the electrode surfaces 140. If the positions of the platen 104 and the support member 118 are inverted, the polishing surfaces 130 are positioned below the electrode surfaces 140. In either embodiment, the different locations of the polishing pad surfaces 130 and the electrode surfaces 140 define channels or recesses 150 between neighboring polishing pad portions 114*a*.

In one aspect of the arrangement shown in FIG. 1, the polishing pad 114 can have a lateral extent greater than that of the workpiece 116 to accommodate relative movement between the polishing pad 114 and the workpiece 116. In another embodiment, the polishing pad 114 can be smaller than the workpiece 116 and can traverse over the workpiece 116 during material removal processes. Further arrangements of polishing pads and adjacent electrodes are disclosed in pending U.S. application Ser. No. 10/230,970, filed Aug. 29, 2002 and incorporated herein in its entirety by reference.

The platen 104 can be coupled to a motor/driver assembly (not shown) that is configured to rotate the platen 104 about an axis 102, in addition to, or in lieu of rotating the support member 118. Accordingly, rotation of the platen 104 and/or the support member 118 provides for relative movement between (a) the workpiece 116 and (b) the electrodes 112 and the polishing pad surfaces 130.

The system 100 can include a conduit 120 configured to dispense a polishing liquid 160 in such a manner that the polishing liquid 160 becomes interposed between the polishing surfaces 130 and the surface 117 of the microfeature workpiece 116 from which material is to be removed. In one embodiment, the conduit 120 delivers the polishing liquid 160 from underneath the polishing pad 114 to the polishing surfaces 120 through openings in the polishing pad portions 114*a*, described in more detail below with reference to FIG. 3.

In one embodiment, the polishing liquid 160 includes tetramethylammonium hydroxide (TMAH). The polishing liquid 160 can also include a suspension of abrasive particles (or abrasive particles can be fixedly disposed in the polishing pad 114). In other embodiments, the polishing liquid 160 can include other constituents. In any of these embodiments, the constituents of the polishing liquid 160 can (a) provide an electrolytic conduction path between the electrodes 112 and the workpiece 116, (b) chemically remove material from the workpiece 116, and/or (c) physically abrade and/or rinse material from the workpiece 116.

Figure 2:
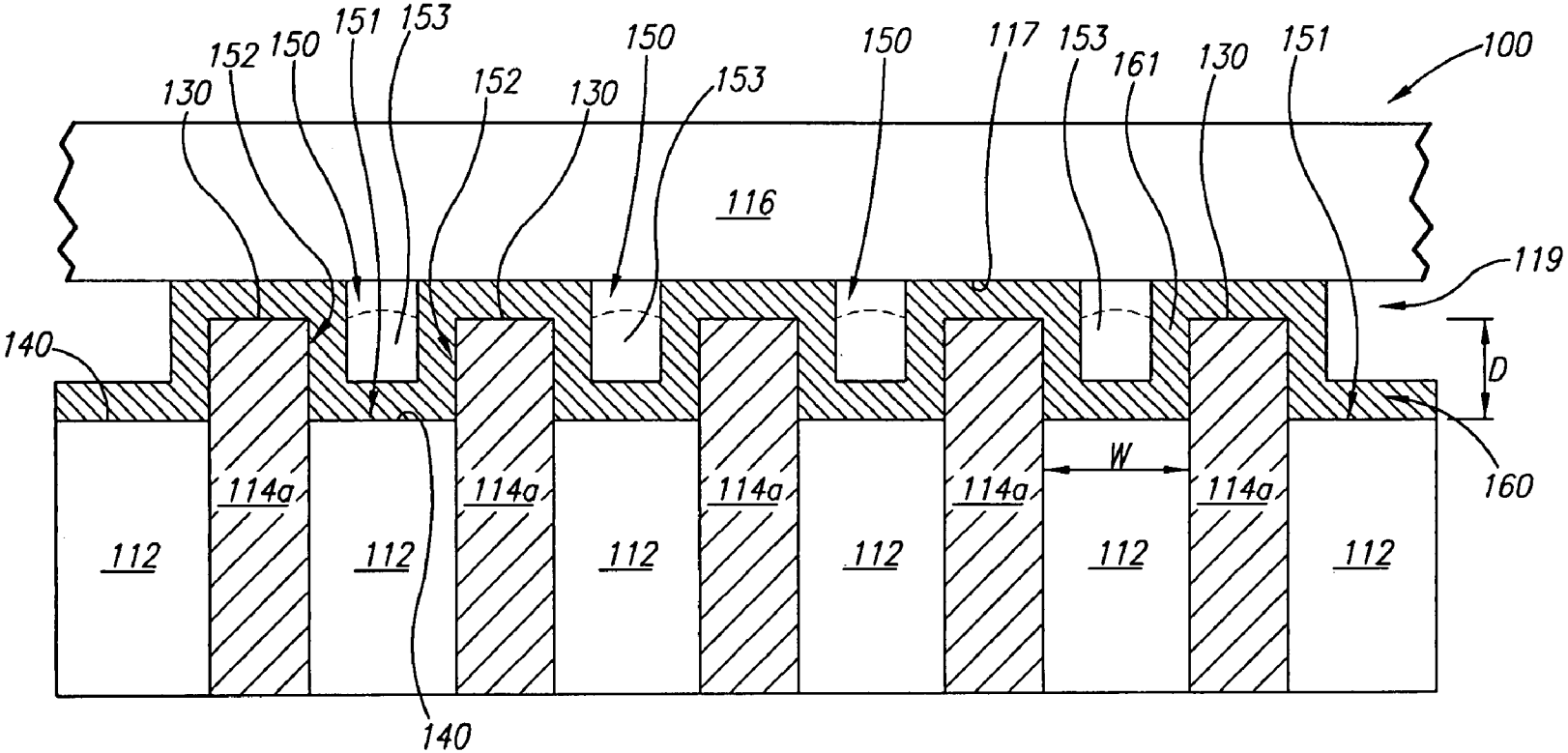
FIG. 2 is a schematic side view of the system shown in FIG. 1, during polishing of a microfeature workpiece in accordance with an embodiment of the invention.

FIG. 2 is a partially schematic illustration of a portion of the system 100 described above with reference to FIG. 1, as it removes material from the microfeature workpiece 116 in accordance with an embodiment of the invention. As shown in FIG. 2, each channel 150 between neighboring polishing pad portions 114*a* can include a channel base 151 and channel sidewalls 152 extending away from the base 151 toward the workpiece 116. In one aspect of this embodiment, the sidewalls 152 can be formed by the laterally facing surfaces of the polishing pad portions 114*a*, and the base 151 can be formed by the electrode surface 140 facing toward the workpiece 116. In other embodiments, the surfaces of each channel 150 can be formed by other structures. For example, the channel base 151 can be formed by a thin dielectric layer positioned over the electrodes 112. In another embodiment, the channel base 151 can be formed by a thin layer of polishing pad material that extends over the electrode surfaces 140 between neighboring polishing pad portions 114*a*. In any of these embodiments, each channel 150 can have a width W between neighboring polishing pad portions 114*a* a depth D between the polishing pad surface 130 and the channel base 151.

When the polishing liquid 160 is disposed adjacent to the workpiece 116, it forms a layer 161 positioned between the workpiece surface 117 and the polishing pad surfaces 130. The layer 161 also extends into the channels 150 to provide electrical communication between the workpiece surface 117 and the electrodes 112. In one aspect of this embodiment, the layer 161 of polishing liquid 160 does not fill the entire channel 150. Instead, a gap 153 forms between the workpiece surface 117 and the channel base 151. In one aspect of this embodiment, the gap 153 can expose the workpiece surface 117 facing directly toward the channel base 151. In another aspect of this embodiment, the polishing liquid 160 can adhere to the workpiece surface 117, as indicated in dashed lines in FIG. 2. In either of these embodiments, the gap 153 can at least reduce (and in at least one embodiment, prevent) material from being removed from the workpiece 116 by direct electropolishing.

Material is still removed from the workpiece 116 by ECMP, proximate to the interface between the polishing pad surfaces 130 and the workpiece surface 117. At this interface, material can be removed from the workpiece surface 117 by (a) electrical interaction with current passed through the workpiece 116 from the electrodes 112 via the liquid layer 161; (b) chemical interaction with chemicals in the polishing liquid 160; and (c) mechanical interaction with the polishing pad surfaces 130.

Aspects of the system 100 and its operation can promote the formation of the gap 153 described above. For example, the depth D of the channel 150 in which the gap 153 is formed can be sized to promote the formation of the gap 153. In a particular embodiment, the depth D can range from about 0.5 mm to about 10 mm. In a further particular embodiment, the depth D can have a value of from about 2 mm to about 4 mm. The channel 150 can also have a width W of about 0.375 inch. In yet further embodiments, the depth D and the width W can have other values, depending, for example, on the characteristics of the polishing liquid 160 (e.g., its viscosity), and/or the rate of relative movement between the workpiece 116 and the polishing pad 114. For example, as discussed above, the workpiece 116 can be rotated at a rate of from about 10 rpm to about 500 rpm or, more particularly, from about 50 rpm to about 200 rpm, and, still more particularly, at about 100 rpm. Rotating the microfeature workpiece 116 tends to move the polishing liquid 160 rapidly through the channels 150 via centrifugal force, thereby promoting the formation of the gaps 153.

The rate with which the polishing liquid 160 is disposed at the interface between the polishing pad 114 and the microfeature workpiece 116 can also be used to control the formation of the gaps 153 in the polishing liquid 160. For example, the rate with which the polishing liquid 160 is dispensed can be kept below a threshold value to reduce the likelihood for completely filling the channels 150, which would eliminate the gaps 153. In a particular embodiment, the polishing liquid 160 is dispensed at a rate of less than one liter per minute, for example, when the workpiece 116 has a diameter of from about 200 mm to about 300 mm. In other embodiments, the polishing liquid 160 is dispensed at other rates that are low enough to allow the gaps 153 to form.

Figure 3:
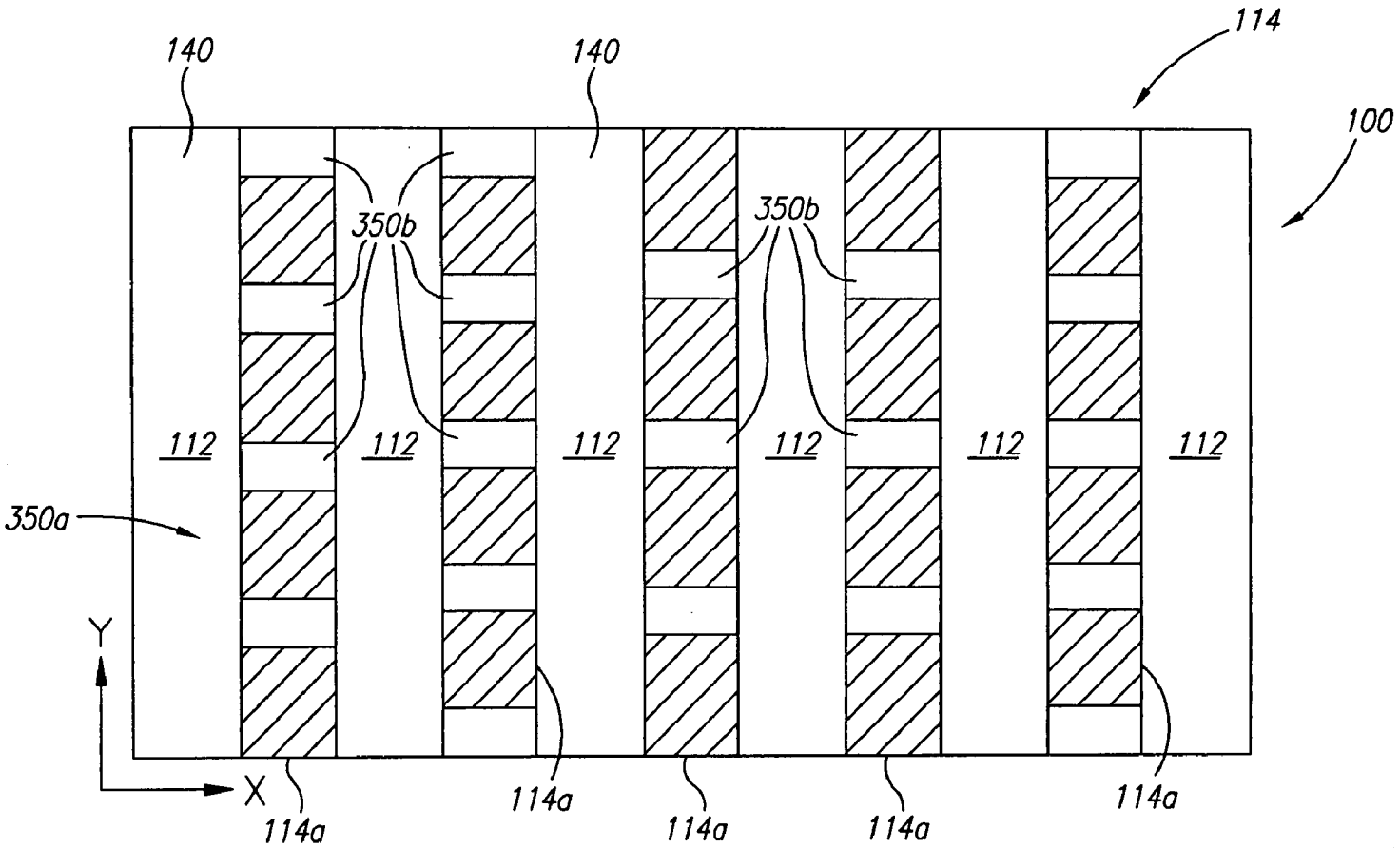
FIG. 3 is a schematic top view of a polishing pad and electrodes configured in accordance with an embodiment of the invention.

FIG. 3 is a top plan view of an embodiment of the system 100 described above, with the support member 118 and the workpiece 116 removed for purposes of illustration. The polishing pad 114 includes first channels 350*a* (generally similar to the channels 150 described above) and second or intersecting channels 350*b* that extend transversely between neighboring first channels 350*a*. The second channels 350*b* can more uniformly distribute the polishing liquid 160 (FIG. 2) over the polishing pad 114. The second channels 350*b* can also provide more avenues by which the polishing liquid 160 passes between the workpiece 116 and the polishing pad 114, to promote the formation of the gaps 153 described above with reference to FIG. 2. In one aspect of this embodiment, at least some of the second channels 350*b* can be in fluid communication with the conduit 120 (FIG. 1) to provide a path by which the polishing liquid 160 is delivered to the polishing pad 114 and the electrodes 112. The second channels 350*b* can have a depth (transverse to the plane of FIG. 3) that is the same as, greater than, or less than the depth D of the channels 150 (FIG. 2).

In one aspect of an embodiment shown in FIG. 3, the first channels 350*a* and the second channels 350*b* are oriented parallel to rectilinear, orthogonal axes Y and X, respectively. In other embodiments, the channels 350*a* and 350*b* can have other orientations. For example, the first channels 350*a* can extend radially from a common center, and the second channels 350*b* can be arranged concentrically about the center.

Figure 4:
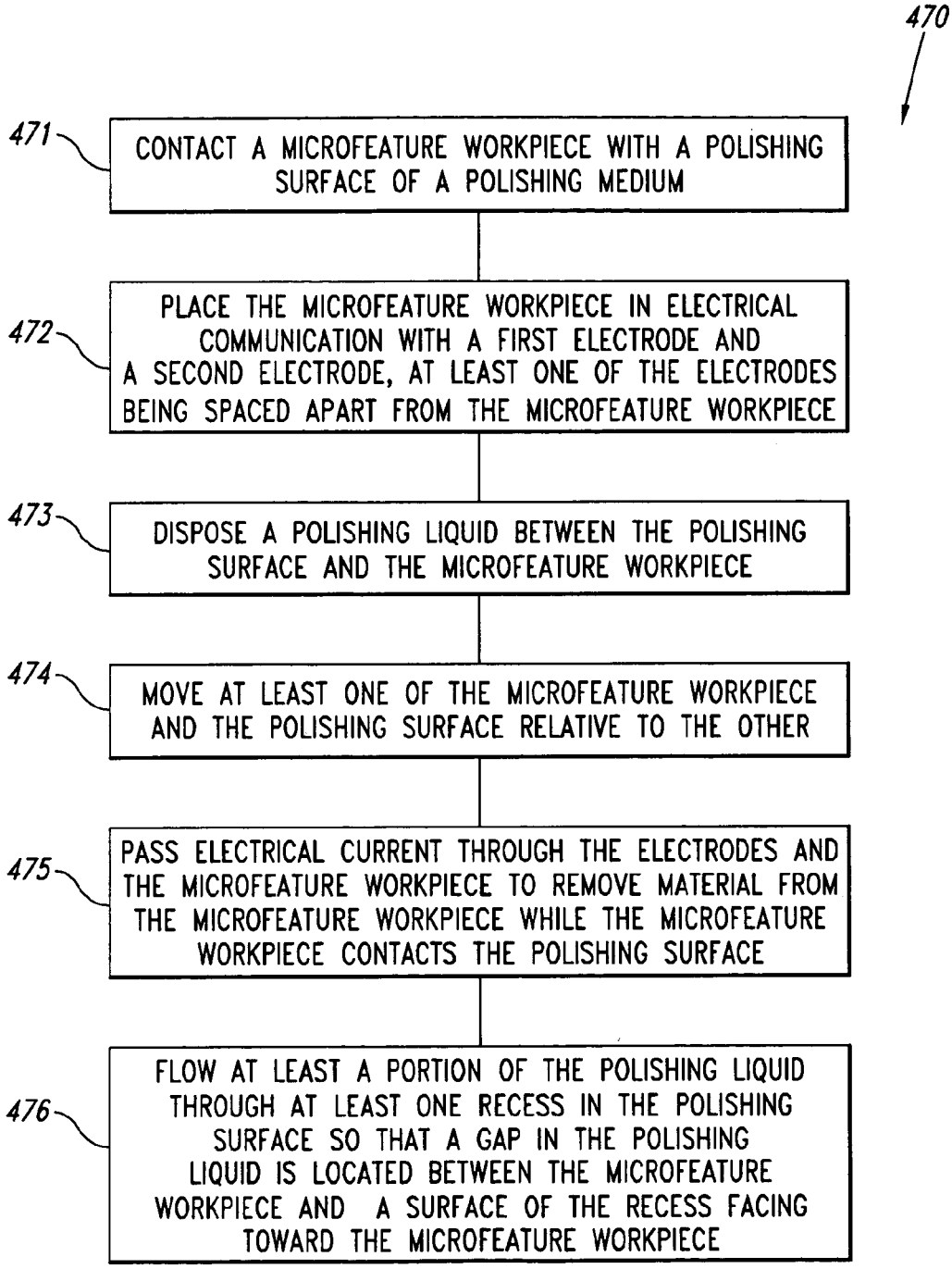
FIG. 4 is a flow diagram for removing material from a workpiece via electrochemical-mechanical polishing in accordance with an embodiment of the invention.

FIG. 4 is a flow diagram illustrating a process 470 for removing material from a microfeature workpiece in accordance with an embodiment of the invention. In process portion 471, the microfeature workpiece is contacted with a polishing surface of a polishing medium, e.g. a polishing pad. The microfeature workpiece is then placed in electrical communication with a first electrode and a second electrode, with at least one of the electrodes being spaced apart from the microfeature workpiece (process portion 472). The process 470 further includes disposing a polishing liquid between the polishing surface and the microfeature workpiece (process portion 473) and moving at least one of the microfeature workpiece and the polishing surface relative to the other (process portion 474). In process portion 475, electrical current is passed through the electrodes and the microfeature workpiece to remove material from the microfeature workpiece while the microfeature workpiece contacts the polishing surface. In process portion 476, at least a portion of the polishing liquid is flowed through at least one recess in the polishing surface so that a gap in the polishing liquid is located between the microfeature workpiece and a surface of the recess facing toward the microfeature workpiece.

One feature of the arrangements described above with reference to FIGS. 1–4 is that the contribution of direct electropolishing to the overall removal rate of material from the workpiece 116 (as defined by Equation 1 above) can be reduced in comparison to the amount of material removed by electrochemical-mechanical polishing. An advantage of this arrangement is that the resulting finish of the workpiece surface 117 may be smoother than it would otherwise be. In particular, direct electropolishing can result in an uneven removal of metal ions from the workpiece 116. By reducing the relative amount of material removed by direct electropolishing, this effect can be reduced or eliminated. Accordingly, the quality of the workpiece 116 after the material removal process can be improved when compared with existing processes. For example, the planarity of the workpiece surface 117 can be increased. An advantage of this feature is that extremely small structures can be more reliably and accurately formed on or in the workpiece surface 117, which improves the quality and reliability of electronic components formed from the workpiece 116.

From the foregoing, it will be appreciated that specific embodiments of the invention have been described herein for purposes of illustration, but that various modifications may be made without deviating from the spirit and scope of the invention. For example, adjacent electrodes such as those shown in FIG. 2 may be coupled to the same pole of the electrical potential source 106. The electrodes can have shapes and orientations different then those shown in FIGS. 2 and 3 depending, for example, on the characteristics of the workpiece 116 being processed. Accordingly, the invention is not limited except as the appended claims.

I claim:

1. A method for removing material from a microfeature workpiece, comprising:

contacting a microfeature workpiece with a polishing surface of a polishing medium;

placing the microfeature workpiece in electrical communication with a first electrode and a second electrode, the first and second electrodes being spaced apart from the microfeature workpiece;

disposing a polishing liquid between the polishing surface and the microfeature workpiece;

moving at least one of the microfeature workpiece and the polishing surface relative to the other;

passing electrical current through the electrodes and the microfeature workpiece to remove material from the microfeature workpiece while the microfeature workpiece contacts the polishing surface;

passing at least a portion of the polishing liquid through at least one recess in the polishing surface so that a gap in the polishing liquid is formed and located at least partially in the recess and between the microfeature workpiece and a surface of the recess facing toward the microfeature workpiece; and controlling formation of the gap in the polishing liquid to achieve a desired electropolishing rate.

2. The method of claim 1 wherein moving at least one of the microfeature workpiece and the polishing surface relative to the other includes rotating the microfeature workpiece.

3. The method of claim 1 wherein removing material from the microfeature workpiece includes (a) removing at least a first portion of the material by electrochemical-mechanical polishing and (b) removing no material by direct electropolishing or removing a second portion less than the first portion by direct electropolishing.

4. The method of claim 1 wherein the surface of the recess includes a surface of the at least one electrode, and wherein passing at least a portion of the polishing liquid through the recess includes passing polishing liquid through the recess with the gap in the polishing liquid being located between the surface of the at least one electrode and a surface of the microfeature workpiece facing toward the surface of the at least one electrode.

5. The method of claim 1 wherein moving at least one of the microfeature workpiece and the polishing surface includes rotating the polishing surface.

6. The method of claim 1 wherein moving at least one of the microfeature workpiece and the polishing surface includes rotating the microfeature workpiece at a rate of from about 10 rpm to about 500 rpm.

7. The method of claim 1 wherein moving at least one of the microfeature workpiece and the polishing surface includes rotating the microfeature workpiece at a rate of from about 50 rpm to about 200 rpm.

8. The method of claim 1 wherein moving at least one of the microfeature workpiece and the polishing surface includes rotating the microfeature workpiece at a rate of about 100 rpm.

9. The method of claim 1 wherein moving at least one of the microfeature workpiece and the polishing surface includes rotating the microfeature workpiece at a rate of about 100 rpm or more.

10. The method of claim 1 wherein disposing the polishing liquid includes disposing the polishing liquid at a rate of less than one liter per minute.

11. The method of claim 1 wherein flowing at least a portion of the polishing liquid through at least one recess includes flowing at least a portion of the polishing liquid through a recess having a dimension generally normal to the microfeature workpiece of from about 0.5 mm to about ten mm.

12. The method of claim 1 wherein flowing at least a portion of the polishing liquid through at least one recess includes flowing at least a portion of the polishing liquid through a recess having a dimension generally normal to the microfeature workpiece of from about two mm to about four mm.

13. The method of claim 1 wherein flowing at least a portion of the polishing liquid through at least one recess includes flowing at least a portion of the polishing liquid through a recess having a dimension of about 0.375 inch generally parallel to a surface of the microfeature workpiece in contact with the polishing surface.

14. The method of claim 1 wherein disposing a polishing liquid includes disposing a polishing liquid having TMAH.

15. The method of claim 1 wherein flowing at least a portion of the polishing liquid through at least one recess includes flowing at least a portion of the polishing liquid through a plurality of intersecting recesses.

16. The method of claim 1 wherein contacting a microfeature workpiece with a polishing surface includes contacting a downwardly facing surface of the microfeature workpiece with an upwardly facing polishing surface.

17. A method for removing material from a microfeature workpiece, comprising:

contacting a microfeature workpiece with a polishing surface of a polishing medium;

placing the microfeature workpiece in electrical communication with a first electrode and a second electrode, the first and second electrodes being spaced apart from the microfeature workpiece;

disposing a polishing liquid between the polishing surface and the microfeature workpiece;

passing an electrical current from the first electrode through the microfeature workpiece to the second electrode to remove material from the microfeature workpiece while the microfeature workpiece is in contact with the polishing surface;

rotating at least one of the microfeature workpiece and the polishing surface relative to the other;

passing at least a portion of the polishing liquid through recesses in the polishing surface so that a gap in the polishing liquid is formed and located at least partially in the recess and between the microfeature workpiece and surfaces of the first and second electrodes located in the recesses, the gap providing a discontinuity in the volume of polishing liquid between the surfaces of the first and second electrodes and a surface of the microfeature workpiece facing toward the surfaces of the first and second electrodes; and controlling formation of the gap in the polishing liquid to achieve a desired electropolishing rate.

18. The method of claim 17 wherein removing material from the microfeature workpiece includes (a) removing at least a first portion of the material by electrochemical-mechanical polishing and (b) removing no material by direct electropolishing or removing a second portion less than the first portion by direct electropolishing.

19. The method of claim 17 wherein moving at least one of the microfeature workpiece and the polishing surface includes rotating the microfeature workpiece at a rate of about 100 rpm.

20. The method of claim 17 wherein disposing the polishing liquid includes disposing the polishing liquid at a rate of less than one liter per minute.

21. The method of claim 17 wherein passing at least a portion of the polishing liquid through at least one recess includes flowing at least a portion of the polishing liquid through a recess having a dimension generally normal to the microfeature workpiece of from about two mm to about four mm.

22. The method of claim 17 wherein disposing a polishing liquid includes disposing a polishing liquid having TMAH.

23. The method of claim 17 wherein passing at least a portion of the polishing liquid through recesses includes passing at least a portion of the polishing liquid through a plurality of intersecting recesses.

24. The method of claim 17 wherein contacting a microfeature workpiece with a polishing surface includes contacting a downwardly facing surface of the microfeature workpiece with an upwardly facing polishing surface.

* * * * *